US006086279A

United States Patent [19]

Yen

[11] Patent Number: 6,086,279

[45] Date of Patent: Jul. 11, 2000

[54] WRITING INSTRUMENT

[75] Inventor: Ming-Hua Yen, Taipei Hsien, Taiwan

[73] Assignee: Mcaide Enterprise Co., Ltd., Taipei Hsien, Taiwan

[21] Appl. No.: 09/413,337

[22] Filed: Oct. 12, 1999

[30] Foreign Application Priority Data

Oct. 21, 1998 [TW] Taiwan ..... 087217390

[51] Int. Cl.[7] ..... B43K 5/00

[52] U.S. Cl. ..... 401/202; 198/205; 198/206

[58] Field of Search ..... 401/198, 196, 401/199, 202, 205, 206

[56] References Cited

U.S. PATENT DOCUMENTS

| | | | |
|---|---|---|---|
| 5,035,525 | 7/1991 | Konose | 401/205 |
| 5,297,883 | 3/1994 | Ozu | 401/202 |
| 5,362,168 | 11/1994 | Abe et al. | 401/206 |
| 5,971,647 | 10/1999 | Loulourgas | 401/202 |

*Primary Examiner*—David J. Walczak
*Attorney, Agent, or Firm*—Dougherty & Troxell

[57] ABSTRACT

A writing instrument includes a barrel, an ink reservoir, an ink outlet ring, a control valve, an ink absorbing sponge, a core seat, a nib and a cap. The barrel has an upper portion forming an upper barrel chamber of a larger external diameter, an intermediate section forming a lower barrel chamber, and a lower section forming a barrel channel of an even smaller internal diameter. The ink reservoir is adapted to receive ink. The control valve includes a valve seat, a valve cap, and a spring. The center of the valve seat has a seat hole passing through and communicated with a seat clearance of a smaller size at a lower end. An upper end of the valve seat is centrally provided with a projecting seat rod. A seat wing projects from a lower portion of the valve seat, with a seat post having the seat clearance disposed below. The ink absorbing sponge is adapted to absorb ink. The core seat has an upper section forming a hollow sponge chamber that is communicated with a core tube of a smaller size at a lower section. The nib has an intermediate section the external diameter of which corresponds to the core tube. The cap has an interior space shaped and sized to match those of the lower section of the barrel, and is provided with a cap stepped portion. The nib is inserted into the core tube, and the ink absorbing sponge is disposed in the sponge chamber.

5 Claims, 3 Drawing Sheets

WRITING INSTRUMENT

BACKGROUND OF THE INVENTION (a) Field of the Invention

The present invention relates to a writing instrument, more particularly to a writing instrument that permits smooth flow of ink when in use and ensures against dripping.

(b) Description of the Prior Art

Writing instruments are indispensable articles, and there are a great variety of writing instruments on the market. Some vary in terms of function, some in design.

Apart from the common pencils, ball point pens and fountain pens, there are a type of pen of a relatively large nib that is used for marking, drawings, such as markers, sign pens, felt pens, etc. One characteristic of such pens is that the barrel thereof contains an ink absorbing sponge that absorbs and holds the ink, and the nib is formed from a fiber capable of performing capillary action. The nib is communicated with the ink absorbing sponge to obtain an ink supply so that it can be used for writing purposes.

In the above-mentioned pens, for instance, markers and sign pens, since the nib is exposed on the outside, the ink in the nib may become dry after a period of time, and the ink has to be refilled, which is rather inconvenient. There is another type of pen in which the ink absorbing sponge is eliminated. The nib directly presses an internal valve to cause the ink to flow to the nib. A disadvantage with such a construction is that the nib may become split after a period of use due to frequent pressing. Moreover, each pressing can allow only a limited amount of ink to the nib and hence permit only a limited number of words. Besides, improper pressing may result in rise of pressure, which makes the nib over-saturated with ink and drip.

SUMMARY OF THE INVENTION

A primary object of the present invention is to provide a writing instrument that permits smooth flow of ink during writing and ensures against dripping.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
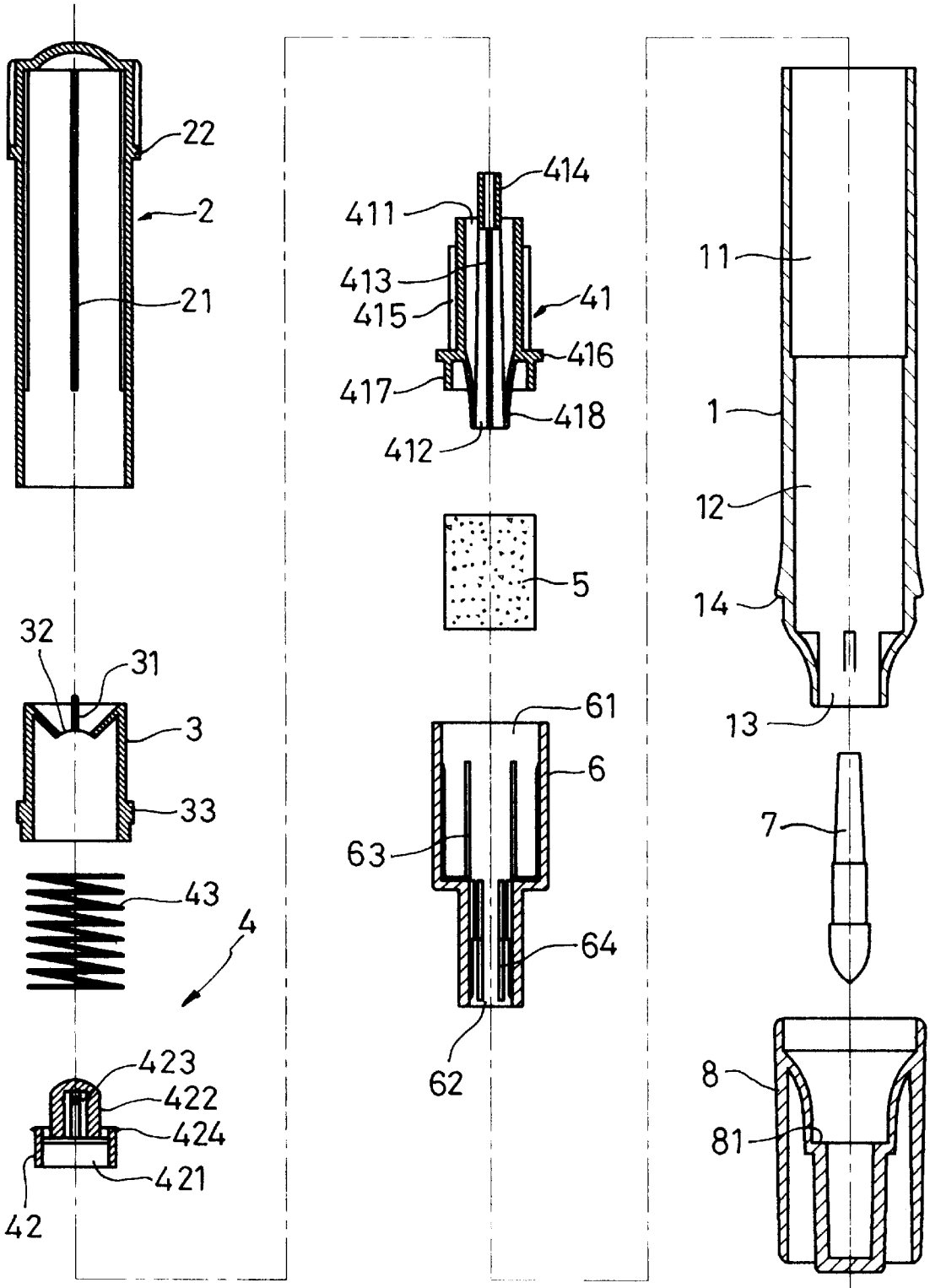
FIG. 1 is an exploded sectional view of the present invention.
Figure 2:
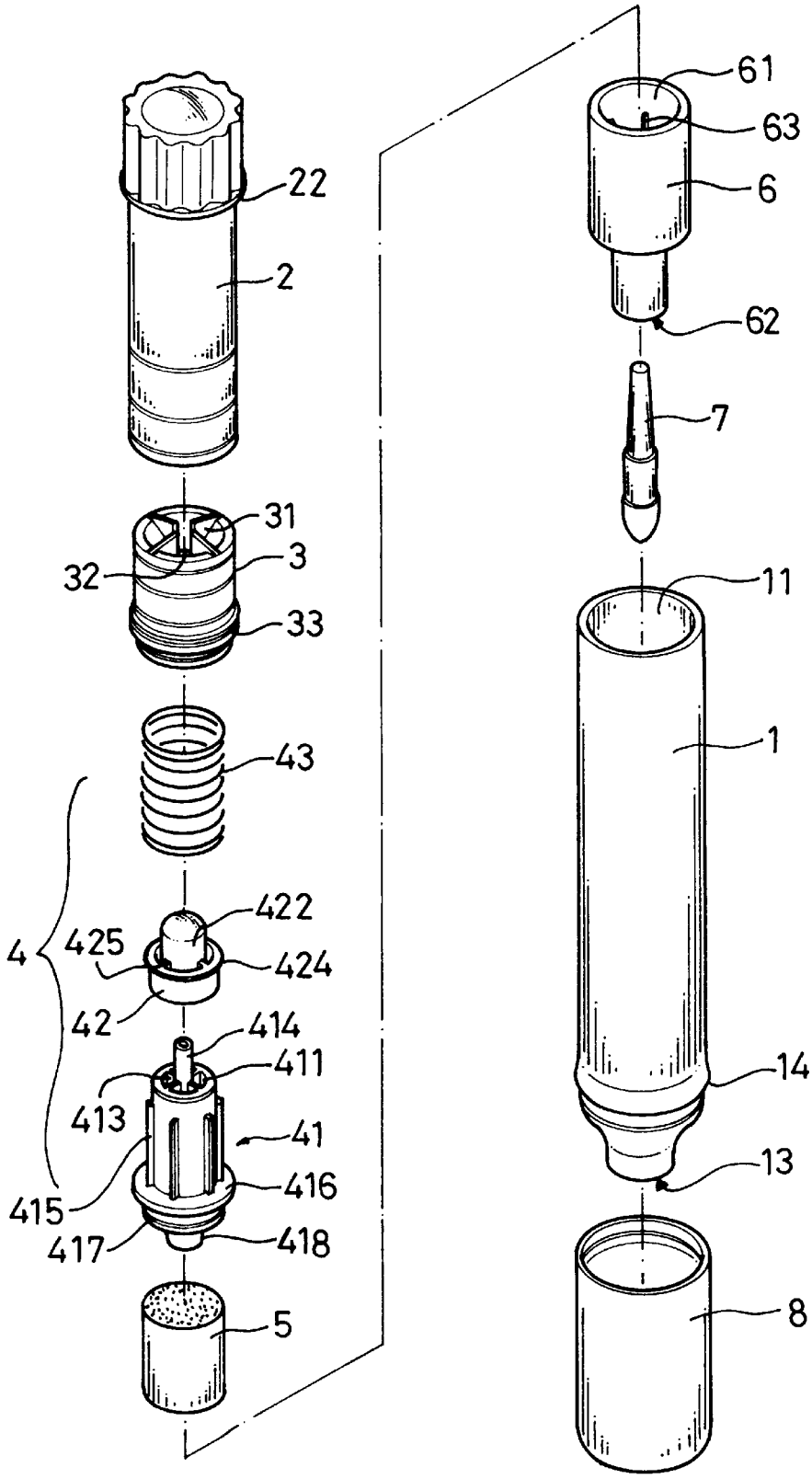
FIG. 2 is an exploded perspective view of the present invention.
Figure 4:
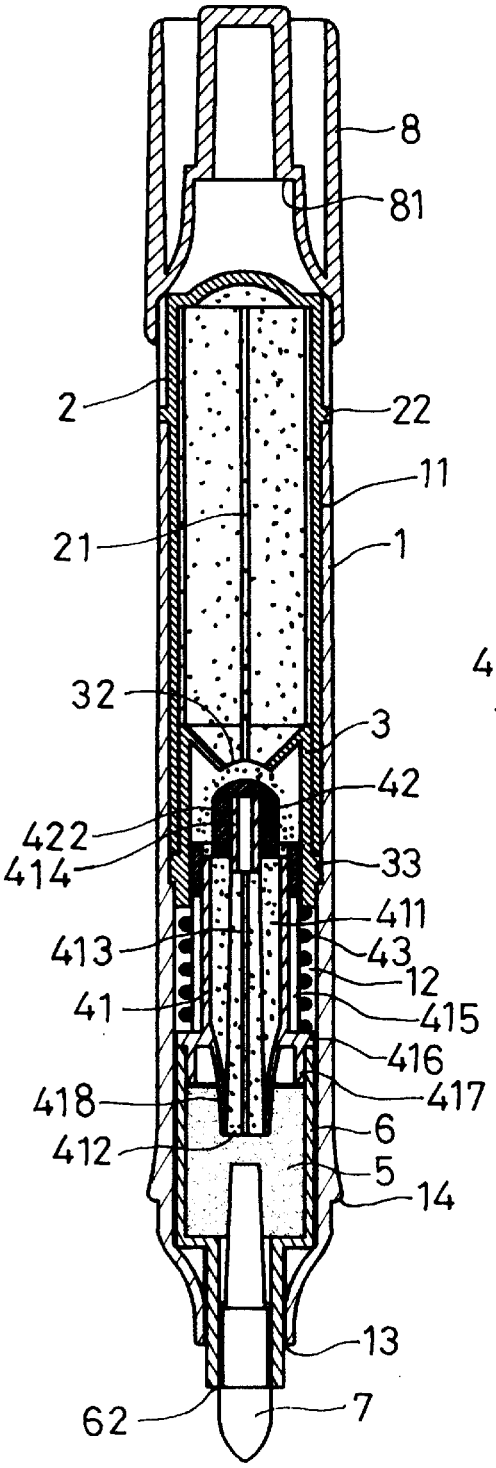
FIG. 4 is a sectional perspective view of the present invention showing that the ink is being supplied.
Figure 3:
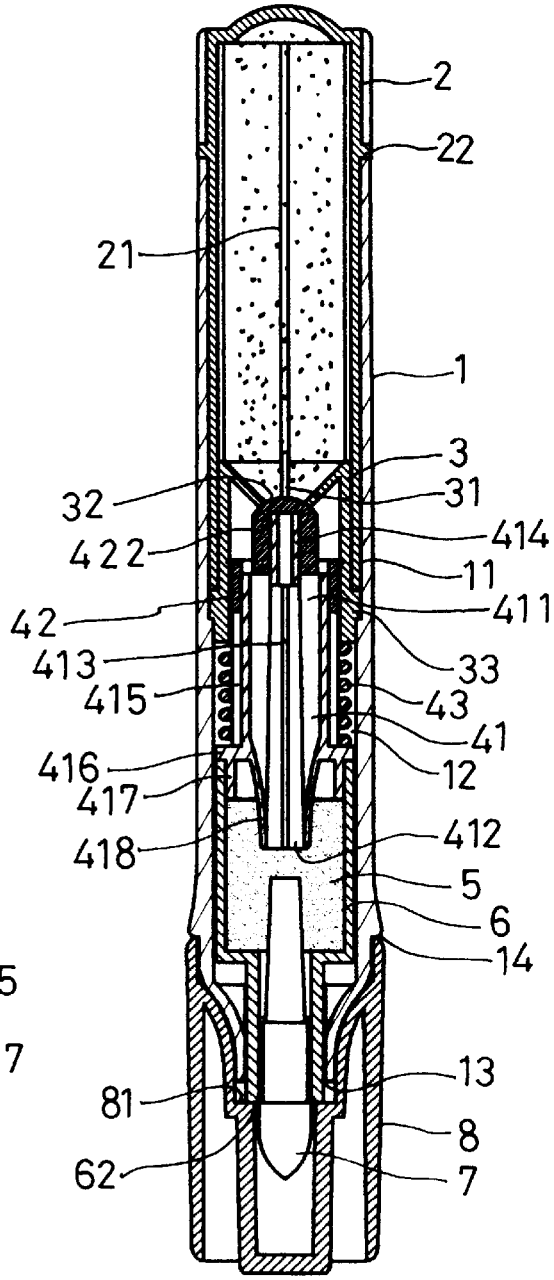
FIG. 3 is a sectional perspective view of the present invention showing the ink in a blocked condition.

With reference to FIGS. 1 to 3, a writing instrument of the present invention includes a barrel 1, an ink reservoir 2, a liquid outlet ring 3, a control valve 4, an ink absorbing sponge 5, a core seat 6, a nib 7, and a cap 8.

The barrel 1 is a hollow elongated rod-like structure that has varying thickness and that includes an upper section forming an upper barrel chamber 11 of a larger internal diameter, a lower section forming a lower barrel chamber 12, and an end portion forming a barrel channel 13 of a smaller diameter. An outer wall of the barrel 1 near a lower portion thereof is reduced in a curved configuration to form barrel stepped portion 14 to serve as a limit when the cap 8 is put in place.

The ink reservoir 2 is adapted for storing ink and includes a closed upper end and an open lower end. An upper section of the ink reservoir 2 has an inner wall the periphery of which is provided with a plurality of ribs 21 to serve as stops when the liquid outlet ring 3 is fitted in place. The upper section of the outer wall of the ink reservoir 2 has a larger external diameter forming a reservoir stepped portion 22 to serve as a limit when the barrel 1 is fitted in place.

The liquid outlet ring 3 is a hollow annular structure that has an upper end provided with a plurality of rib portions 31 extending downwardly towards a central portion so that the central portion forms a curved ring hole 32 that projects upwardly. An outer wall of the liquid outlet ring 3 near a lower end thereof is provided with a ring projection 33 that has a larger external diameter and a size corresponding to that of the upper barrel chamber 11.

The control valve 4 includes a valve seat 41 that has a valve cap 42 fitted at an upper end thereof and inserted into a spring 43. The valve seat 41 is an elongated post having a seat hole 411 passing through a central portion thereof longitudinally. The valve seat 41 has a lower end of a smaller size forming a seat clearance 412 adapted to serve as an ink outlet. The seat hole 411 is internally provided with a plurality of spaced seat ribs 413 that are connected to a seat rod 414 that is located at the center and that projects upwardly. The periphery of an outer wall of the valve seat 41 is provided with a plurality of longitudinally oriented wing strips 415. A lower section of the valve seat 41 has an increased external diameter forming a seat wing 416, with a wing ring 417 of a smaller external diameter disposed below. The central portion of the valve seat 41 extends downwardly to form a seat post 418 having the above-mentioned seat clearance 412.

The valve cap 42 is a lower portion forming a hollow cap hole 421, and an upper portion provided with a cap post 422 that projects therefrom and has a smaller external diameter. A top end of the valve cap 42 has a curvature corresponding to the ring hole 32 so that it can be fitted in position. The valve cap 42 is internally provided with a cap clearance 423 that has an internal diameter corresponding to the seat rod 414. An intermediate section of the valve cap 42 has an increased external diameter forming a cap flange 424 that has a plurality of cap ribs 425 connected to an end portion of the cap post 422 to confine a plurality of spaces communicated with the cap hole 421. The valve cap 42 has a height corresponding to a distance from top ends of the wing strips 415 of the valve seat 41 to a top end of the seat rod 414.

The spring 43 is an elongated coil that has an internal diameter corresponding to the external diameter defined by the wing strips 415 of the valve seat 41 so that it can be fitted thereonto but is smaller than the external diameter of the seat wing 416 so that the latter can serve as a stop.

The ink absorbing sponge 5 is well known in the art and is adapted to absorb ink. The size thereof corresponds to that of the core seat 6 to be described hereinafter so that it can be received therein.

The core seat 6 is a hollow annular post that has an upper portion forming a sponge chamber 61 of a larger size and a lower portion forming a core tube 62 of a smaller size for clamping the nib 7 to be described hereinafter. The inner wall of the sponge chamber 61 is annularly provided with a plurality of chamber ribs 63 adapted to reinforce the clamping strength and air compensation of the ink absorbing sponge 5. The inner wall of the core tube 62 is also provided with a plurality of tube ribs 64 in an annular arrangement to reinforce the clamping of the nib 7 and air compensation. The size of the core tube 62 corresponds to that of the lower barrel chamber 12 and that of the barrel channel 13.

The nib 7 is also well known in the art. An intermediate of the nib 7 is sized to correspond to the core tube 62 so that it can be received therein. A lower section thereof has a larger size and projects from the core tube 62 after assembly for writing purposes.

The cap 8 has an open end the internal size thereof corresponds to the profile of the end portion of the barrel 1. The interior of the cap 8 is milled to form a cap stepped portion 81 for abutting the lower end of the core seat 6. In other words, when the cap 8 is fitted in position, the core seat 6 has to be pushed to displace a certain distance before it can be tightly coupled with the lower end of the barrel 1. In addition, the size of the open end of the cap 8 corresponds to the upper end of the ink reservoir 2 so that they can be interengaged. As such is known in the art, a description thereof is dispensed herewith.

With further reference to FIGS. 1 to 3, during assembly, the ink reservoir 2 is fitted onto the ink outlet ring 3 with the ring projection 33 as limit. The valve cap 42 then utilizes the cap clearance 423 to fit onto the seat rod 414 of the valve seat 41 and is fitted with the spring 43. On the other hand, the nib 7 is inserted through the core seat 6 to be positioned in the core tube 62. The ink absorbing sponge 5 is also disposed in the sponge chamber 61 of the core seat 6, which is then disposed at the bottom end of the lower barrel chamber 12 of the barrel 1 such that the nib 7 and the core tube 62 are exposed at the lower end of the barrel 1. At this point, the seat post 418 pierces into the ink absorbing sponge 5, and the valve cap 42, together with the valve seat 41 and the spring 43, is disposed in the lower barrel chamber 12 of the barrel 1. The ink outlet ring 3 and the ink reservoir 2 are placed inside the barrel 1 with the reservoir stepped portion 22 serving as a stop. The cap 8 is then fitted in place to achieve a writing instrument as shown in FIG. 3, in which there is no output of ink. At this point, the cap 8 abuts against the lower portion of the core seat 6 so that the core seat 6 urges upwardly against the valve seat 41 and valve cap 42 above, which in turn urge upwardly, causing the upper end of the cap post 422 to abut against the ring hole 32 of the ink outlet ring 3. Therefore, the ink cannot flow downwardly out. Hence, even if the temperature rises during transportation is resulting in increased internal pressure inside the ink reservoir 2, the ink will not flow out.

However, when the cap 8 is removed, since the pressure on the core tube 62 is released and the spring 43 rebounds, the core seat 6 along with the valve seat 41 and the valve cap 42 displaces downwardly so that the upper portion of the cap post 422 of the valve cap 42 disengages from the ring hole 32, thereby permitting the ink to flow through the ring hole 32 and the cap hole 421, the seat hole 411, and the seat clearance 412 to the ink absorbing sponge 5 and further to the nib 7 for writing purposes. During the process of writing, ink keeps flowing out from the ink reservoir 2 due to air compensation. At this point, since the seat post 418 is dipped in the ink absorbing ink 5 and is in contact therewith, there is a balancing or regulatory effect, preventing the ink from flowing out continuously to cause overflowing of ink.

When not in use, the cap 8 is fitted to the lower end of the barrel 1 to cause the core seat 6, the valve seat 41, and the valve cap 42 to urge upwardly so that the cap post 422 urges against the ring hole 32 to block outflow of ink, thereby avoiding drying up.

In summary, the cap 8 can be fitted in place to block outflow of ink or opened to allow outflow of ink. Such operation is simple and quick. Besides, the use of a cap to control the supply of ink is also new in the art.

Although the present invention has been illustrated and described with reference to the preferred embodiment thereof, it should be understood that it is in no way limited to the details of such embodiment but is capable of numerous modifications within the scope of the appended claims.

What is claimed is:

1. A writing instrument, comprising:

a barrel being an elongated hollow barrel structure that has an upper portion forming an upper barrel chamber of a larger external diameter, an intermediate section forming a lower barrel chamber, and a lower section forming a barrel channel of an even smaller internal diameter;

an ink reservoir having a closed upper end and an open lower end, a lower section thereof having an external diameter corresponding to the internal diameter of said upper barrel chamber and being adapted to receive ink;

a liquid outlet ring that is an annular ring having an upper end provided with a plurality of rib portions that extend towards a central portion, said central portion forming a ring hole, a lower end of said liquid outlet ring having an outer wall projecting outwardly to form a ring projection;

a control valve including a valve seat, a valve cap, and a spring, said valve seat being centrally provided with a through seat hole that runs longitudinally through to a seat clearance of a smaller size at a lower end, an upper portion of said valve seat being centrally provided with a seat rod that projects therefrom, a seat wing being provided near a lower portion in a projecting manner, a lower section of said valve seat forming a seat post having said seat clearance; said valve cap having a lower portion forming a cap hole and an upper portion provided with a cap post of a smaller external diameter and projecting therefrom, said cap post having a top end corresponding to said ring hole and a cap clearance corresponding to said seat rod, an intermediate section of said cap post having an enlarged periphery forming a cap flange that has a plurality of cap ribs connected to an end portion of said cap post to confine a plurality of spaces communicated with said cap hole; said spring being an elongated coil that has an internal diameter of a size larger than said valve seat but smaller than the external diameter of said seat wing;

an ink absorbing sponge adapted to absorb ink;

a core seat having an upper section forming a hollow sponge chamber communicated with a core tube of a smaller size at a lower section thereof;

a nib having an intermediate section the external diameter of which corresponds to said core tube; and a cap having an interior space corresponding to the size and shape of the lower section of said barrel, and a cap stepped portion;

whereby said nib is inserted into said core tube and said ink absorbing sponge is disposed in said sponge chamber, said core chamber being insertably disposed in said lower section of said barrel such that said core tube and said nib are exposed on the outside, said valve cap being insertably fitted at a top end of said valve seat, said spring being fitted over said valve seat and insertably disposed in said barrel, said liquid outlet ring being fitted to a lower end of said ink reservoir and insertably disposed in said barrel, said cap, after being fitted in position, urging upwardly against said core tube to cause said valve seat and said valve cap to urge upwardly so that said valve cap conceals said ring hole to block outflow of ink, said cap being removed to allow said spring to rebound and said cap post to disengage from said ring hole so that ink can flow from said ring hole through said cap hole, said seat hole, and said seat clearance to said ink absorbing sponge.

2. A writing instrument as defined in claim 1, wherein said ink reservoir has an inner wall an upper section of which is provided with a plurality of ribs to serve as a limit for said ink outlet ring below.

3. A writing instrument as defined in claim 1, wherein said core seat has an inner wall provided with ribs adapted to reinforce clamping force thereof.

4. A writing instrument as defined in claim 1, wherein an upper section of said seat wing of said valve seat is annularly provided with a plurality of wing strips.

5. A writing instrument as defined in claim 1, wherein said seat wing of said valve seat has an annular wing ring disposed at a lower portion thereof.

* * * * *